US012503300B2

(12) United States Patent
Herolf et al.

(10) Patent No.: US 12,503,300 B2
(45) Date of Patent: Dec. 23, 2025

(54) FREIGHT CONTAINER COMPRISING ENVIRONMENTAL SENSORS AND METHOD FOR SENSING AN ENVIRONMENTAL PARAMETER

(71) Applicant: ENVIROTAINER ENGINEERING AB, Sollentuna (SE)

(72) Inventors: Anders Herolf, Stockholm (SE); Thomas Sköld, Upplands Väsby (SE); Martin Johansson, Sollentuna (SE)

(73) Assignee: ENVIROTAINER ENGINEERING AB, Sollentuna (SE)

( * ) Notice: Subject to any disclaimer, the term of this patent is extended or adjusted under 35 U.S.C. 154(b) by 341 days.

(21) Appl. No.: 18/029,413

(22) PCT Filed: Sep. 29, 2021

(86) PCT No.: PCT/SE2021/050957
§ 371 (c)(1),
(2) Date: Mar. 30, 2023

(87) PCT Pub. No.: WO2022/071860
PCT Pub. Date: Apr. 7, 2022

(65) Prior Publication Data

US 2023/0365326 A1 Nov. 16, 2023

(30) Foreign Application Priority Data

Oct. 2, 2020 (SE) ..... 2051165-5

(51) Int. Cl.
*B65D 88/74* (2006.01)
*B65D 81/24* (2006.01)
(Continued)

(52) U.S. Cl.
CPC ..... *B65D 88/745* (2013.01); *B65D 81/24* (2013.01); *B65D 81/38* (2013.01); *B65D 88/12* (2013.01); *B65D 90/48* (2013.01)

(58) Field of Classification Search
CPC ..... B65D 88/745; B65D 81/24; B65D 81/38; B65D 90/48; B65D 88/12
(Continued)

(56) References Cited

U.S. PATENT DOCUMENTS 3,453,839 A 7/1969 Sabin
4,875,341 A 10/1989 Brandemuehl et al.
(Continued)

FOREIGN PATENT DOCUMENTS

CN 101093099 B * 6/2010
CN 211085494 U * 12/2019
(Continued)

OTHER PUBLICATIONS

Translation CN 211085494 (Year: 2019).*
(Continued)

*Primary Examiner* — Peter J Macchiarolo
*Assistant Examiner* — Monica S Young
(74) *Attorney, Agent, or Firm* — MOSER TABOADA

(57) ABSTRACT

A freight container (10) and a method for sensing at least one of a temperature and a humidity in a freight container are provided. The freight container comprises a cargo compartment (20) being defined by a floor (16), a ceiling (14) and walls (18*a-d*). The freight container comprises a climate arrangement (50), configured for providing conditioned airflow (100) into the cargo compartment of said freight container. The climate arrangement further comprises at least one environmental sensor (52A-E) for sensing a temperature and/or a humidity in the cargo compartment, wherein the at least one environmental sensor is accommo-
(Continued)

dated in at least one recess (60) in at least one of the ceiling and walls.

12 Claims, 7 Drawing Sheets

(51) Int. Cl.
*B65D 81/38* (2006.01)
*B65D 88/12* (2006.01)
*B65D 90/48* (2006.01)

(58) Field of Classification Search
USPC ..... 73/29.02
See application file for complete search history.

(56) References Cited

U.S. PATENT DOCUMENTS

2003/0101742 A1 6/2003 Norelius et al.
2007/0289976 A1* 12/2007 Meyer ..... F25D 17/06 220/592.09
2009/0293524 A1* 12/2009 Vezina ..... B65D 90/004 165/41
2020/0049358 A1* 2/2020 Suciu ..... F24F 11/79
2021/0199331 A1* 7/2021 Hsu ..... G01N 21/81
2021/0206565 A1* 7/2021 Neeld ..... B65D 88/74

FOREIGN PATENT DOCUMENTS

DE 8630333 U1 1/1987
DE 10029355 A1 12/2001
EP 2031326 A2 3/2009
EP 3284702 A1 2/2018
WO WO-9107630 5/1991

OTHER PUBLICATIONS

Swedish Search Report for Application No. 2051165-5 dated Apr. 30, 2021.
International Search Report for Application No. PCT/SE2021/050957 dated Dec. 16, 2021.
Extended European Search Report for Application No. 21876092.4 dated Sep. 17, 2024, 7 pages.

* cited by examiner

FREIGHT CONTAINER COMPRISING ENVIRONMENTAL SENSORS AND METHOD FOR SENSING AN ENVIRONMENTAL PARAMETER

FIELD OF THE INVENTION

The present invention generally relates to the field of freight containers. More specifically, the present invention relates to a freight container comprising one or more environmental sensors.

BACKGROUND OF THE INVENTION

A substantial part of goods that is transported around the world today requires or benefits from having a climate-controlled environment around the goods within the freight containers. In particular, many pharmaceutical companies are today using air transportation to ship temperature-sensitive medicals. The shipments are often governed under regulatory demands and stipulate control of the temperature during the entire shipment. A common demand is to keep the shipment temperature within intervals, such as e.g. 2-8° C. or 15-25° C. Goods like vaccines and insulin are two common medicals that require a strict temperature of 2-8° C. during the whole shipment to its destination. Hence, the demands on environmental control are rigorous, as temperature sensitive goods may be destroyed or deteriorated if they are exposed to a too high and/or a too low temperature during transportation.

To provide such transportation conditions, many freight containers are equipped with different kinds of systems for a regulation of the environment therein. Although freight containers often are provided with temperature and/or humidity regulating equipment that generally is adequate for the purpose of the freight containers, there is still a need for more reliable environmental regulation.

During transport, there may be a risk of one or more components of the regulation system being damaged. It should be noted that the freight container may be particularly susceptible to damage e.g. during loading, de-loading and cargo inspection. In the case of damage on the environmental-regulation system the safety of sensitive goods cannot be guaranteed, and the goods may possibly be destroyed or deteriorated. There is therefore a general need to provide a freight container wherein the environmental-regulation system is less likely to be damaged during transport, which consequentially leads to a more reliable regulation of the freight container with respect to temperature and/or humidity.

SUMMARY OF THE INVENTION

It is an object of the present invention to mitigate one or more of the above problems and to provide a freight container wherein at least a part of the environmental-regulation system is efficiently protected, consequentially leading to a more reliable regulation of the temperature and/or humidity of the freight container.

This and other objects are achieved by providing a freight container and a method having the features in the independent claims. Preferred embodiments are defined in the dependent claims.

Hence, according to a first aspect of the present invention, there is provided a freight container comprising: a cargo compartment being defined by a floor, a ceiling and walls. The freight container further comprises a climate arrangement, configured for providing a climate-conditioned air-flow into the cargo compartment of the freight container. Furthermore, the climate arrangement of the freight container comprises at least one environmental sensor for sensing at least one of a temperature and a humidity in the cargo compartment, wherein at least one of the ceiling and walls comprises at least one recess in which the at least one environmental sensor is accommodated.

According to a second aspect of the present invention, there is provided a method for sensing at least one of a temperature and a humidity in a freight container comprising a cargo compartment being defined by a floor, a ceiling and walls, a climate arrangement, configured for providing a climate-conditioned air-flow into the cargo compartment of the freight container, wherein the climate arrangement comprises at least one environmental sensor for sensing at least one of a temperature and a humidity in the cargo compartment. The method comprises the step of providing at least one recess in at least one of the ceiling and walls. The method further comprises the step of accommodating, in the at least one recess, the at least one environmental sensor for sensing at least one of a temperature and a humidity in the cargo compartment.

Thus, the freight container according to the invention is based on the idea of providing one or more environmental sensors of the climate arrangement in one or more recesses of the ceiling and/or wall(s) of the cargo compartment of the freight container. The environmental sensors are hereby efficiently and conveniently protected from damage. It will be appreciated that the environmental sensor(s) are particularly protected from damage by the goods and/or any equipment for handling the goods, during loading, transportation and/or de-loading of the goods.

The present invention is advantageous in that the provision of protected environmental sensor(s) of the climate arrangement via the recess(es) consequentially leads to a more reliable regulation of the temperature and/or humidity of the freight container. In turn, this leads to a mitigation of goods being destroyed or deteriorated as a result of a malfunctioning or deteriorated climate arrangement.

The present invention is further advantageous in that the provision of one or more recesses in which the environmental sensor(s) are accommodated, the space of the cargo compartment may be used even more efficiently. For example, the cargo compartment may be provided without elements or arrangements for temperature and/or humidity sensing which project into the cargo compartment. Consequently, the capacity of the cargo compartment may increase by virtue of the innovative concept of the present invention.

The present invention is further advantageous in that the provision of one or more recesses in which the environmental sensor(s) are accommodated may lead to a facilitated handling of the goods related to loading and/or de-loading of the goods into (out of) the cargo compartment.

For example, the cargo compartment may be provided without elements or arrangements for temperature and/or humidity sensing which project into the cargo compartment, and thereby possibly interfere with a loading and/or de-loading operation of goods.

The present invention is further advantageous in that the environmental sensor(s) arranged in recess(es) of the cargo compartment may yield an even more accurate temperature and/or humidity sensing in the cargo compartment. This is realized due to the fact that the environmental sensor(s) in the recess(es) are protected to come into contact with goods stored in the cargo compartment. Hence, compared to (projecting) elements or arrangements for temperature and/or humidity sensing which may come into direct contact with goods, and thereby rendering a sensed temperature and/or humidity which may deviate from the actual environment in the cargo compartment, the innovative concept of the present invention may lead to a more accurately sensed environment of the cargo compartment of the freight container.

The present embodiment is further advantageous in that the recessed environmental sensor(s) mitigates, or even completely avoids, any inflicted damage on the goods and/or any equipment for handling the goods, during loading, transportation and/or de-loading of the goods. Hence, compared to (projecting) elements or arrangements for temperature and/or humidity sensing which may damage the goods upon contact, the innovative concept of the present invention may lead to a safer handling and/or transportation of the goods.

There is provided a freight container comprising: a cargo compartment being defined by a floor, a ceiling and walls. Hence, the floor, ceiling and walls define the cargo compartment, which may be formed as a cube or a rectangular cuboid (parallelepiped). The freight container comprises a climate arrangement, configured for providing a climate-conditioned air-flow into the cargo compartment of the freight container. By "climate arrangement", it is here meant substantially any arrangement, device or unit which is able to provide a climate-conditioned air-flow. The climate arrangement of the freight container comprises at least one environmental sensor for sensing at least one of a temperature and a humidity in the cargo compartment. By the term "environmental sensor", it is here meant substantially any element, unit or device which is configured or arranged for temperature and/or humidity sensing, measuring and/or registering. At least one of the ceiling and walls of the cargo compartment of the freight container comprises at least one recess in which the at least one environmental sensor is accommodated. By the term "recess", it is here meant a cavity (i.e. an empty space within the solid ceiling and/or wall(s)), an opening, a through hole (i.e. a hole through the ceiling and/or wall(s), or the like. Hence, the ceiling and/or one or more of the walls of the cargo compartment comprises one or more recesses in which the one or more environmental sensors is accommodated. For example, there may be a single environmental sensor accommodated in each recess of the cargo compartment.

According to an embodiment of the present invention, the at least one recess may comprise a cover configured to hold the at least one environmental sensor. By the term "cover", it is here meant substantially any cover, cap, plate, or the like, which is arranged to hold and/or cover the environmental sensor(s).

According to an embodiment of the present invention, the cover may be arranged flush with at least one of the ceiling and walls in which the at least one environmental sensor is accommodated. In other words, in case the environmental sensor is arranged in a recess which is provided in the ceiling or in one of the walls, the cover is arranged flush with that specific ceiling or wall. Hence, the surface of the ceiling or wall, in which the recess is provided for accommodating the environmental sensor, is even as the cover is arranged flush with that specific ceiling or wall. The present embodiment is advantageous in that the environmental sensor(s) and/or the cover avoids any damage to the goods and/or any equipment for handling the goods, during loading, transportation and/or de-loading of the goods. The present embodiment is further advantageous in that the risk of the goods damaging the environmental sensor(s) is reduced even further. Also, by the even surfaces of the ceiling and/or walls as a result of the cover being arranged flush with the ceiling and/or walls, the present embodiment may improve the capacity of the cargo compartment to an even further extent.

According to an embodiment of the present invention, the cover may comprise a metal plate having a plurality of apertures. The present embodiment is advantageous in that the plurality of apertures may allow a relatively large amount of air to pass through the cover in order for the environmental sensor(s) arranged in the recess(es) to sense the temperature and/or humidity in the cargo compartment as accurately as possible.

According to an embodiment of the present invention, the at least one environmental sensor may resiliently project from at least one of the ceiling and walls in which the at least one environmental sensor is accommodated. In other words, in case the environmental sensor is arranged in a recess which is provided in the ceiling or in one of the walls, the environmental sensor may resiliently project from that specific ceiling or wall. By the term "resiliently project", it is here meant that the environmental sensor, in an unbiased state thereof, may project from the ceiling and/or wall(s), whereas the environmental sensor, in a biased state, may be resiliently compressed towards and/or into the recess. The present embodiment is advantageous in that the environmental sensor(s), in the unbiased state projecting into the cargo compartment, may provide an even more improved temperature and/or humidity sensing. More specifically, the environmental sensor(s) may hereby be even better adapted or arranged to sense a climate-conditioned air-flow from the climate arrangement upon operation thereof. The present embodiment is further advantageous in that the environmental sensor(s), in the biased state being compressed towards and/or into the recess, may provide one or more of the advantages previously mentioned in relation to the arrangement of one or more recessed environmental sensor(s) in the cargo compartment.

According to an embodiment of the present invention, the at least one recess may comprise an insulating portion in a bottom part of the at least one recess. The present embodiment is advantageous in that the insulating portion may insulate the bottom part of the recess such that the sensing of the temperature and/or humidity of the environmental sensor may be even more accurate.

According to an embodiment of the present invention, the at least one environmental sensor comprises a temperature sensor. For example, the environmental sensor(s) may constitute a temperature sensor(s).

According to an embodiment of the present invention, the at least one environmental sensor may comprise a humidity sensor. For example, the environmental sensor(s) may constitute a humidity sensor(s).

According to an embodiment of the present invention, a first dimension, D1, of the at least one recess may be larger than a second dimension, D2, of the environmental sensor in a plane of the at least one of the ceiling and walls, wherein the recess provides a passage of a flow of the climate-conditioned air-flow environmental through the recess. The present embodiment is advantageous in that the environmental sensor may sense the temperature and/or humidity of the air flow which is arranged to flow through the recess.

According to an embodiment of the present invention, the ceiling may comprise an inner portion and an outer portion defining a first space; and at least one of the walls may comprise an inner wall portion and an outer wall portion defining a second space; wherein the first space is fluidically connected to the second space, and the inner wall portion comprises at least one aperture between the second space and the cargo compartment; wherein the climate arrangement is configured to provide the climate-conditioned air-flow into the cargo compartment of the freight container via the first space and the second space; and wherein at least one of the inner portion and the inner wall portion comprises the at least one recess in which the at least one environmental sensor is accommodated. Hence, the climate arrangement is configured to provide the climate-conditioned air-flow into the cargo compartment of the freight container via a double-wall structure of the ceiling and wall(s), wherein the first and second spaces constitute the passages of the double-wall structure in the ceiling and wall(s), respectively.

According to an embodiment of the present invention, only the walls, of the at least one of the ceiling and walls, comprises the at least one recess in which the at least one environmental sensor is accommodated, wherein the inner wall portion of the at least one wall comprises the at least one recess.

According to an embodiment of the present invention, the at least one recess constitutes a through hole in the at least one of the inner portion and the inner wall portion. Hence, the recess in the ceiling and/or wall(s) in which the environmental sensor(s) is (are) accommodated, is provided through the ceiling and/or wall(s). The present embodiment is advantageous in that the environmental sensor may be configured to sense (a) temperature(s) on either side of the inner portion of the ceiling and/or on either side of the inner wall portion of the wall(s), i.e. in the cargo compartment, the first space of the ceiling and/or the second space of the wall(s). The present embodiment is further advantageous in that the environmental sensor may be configured to sense a temperature in the first space and/or the second space in case cargo in the cargo compartment is placed against the recess in which the environmental sensor is arranged in the cargo compartment. In other words, in case cargo in the cargo compartment is placed against the ceiling and/or wall(s) and thereby blocks or inhibits the temperature and/or humidity sensing of the environmental sensor(s) in the cargo compartment, the environmental sensor(s) may still be arranged sense the temperature and/or humidity in the first space of the ceiling and/or in the second space of the wall(s).

According to an embodiment of the present invention, at least one of the walls may comprise an inner wall portion and an outer wall portion defining a third space, wherein the cargo compartment of the freight container is fluidically connected to the third space and wherein the climate arrangement is configured to return a residual air-flow of the climate-conditioned air-flow from the cargo compartment of the freight container via the third space.

According to an embodiment of the present invention, the third space may comprise an auxiliary passage arranged in vicinity of the inner portion of the ceiling, wherein an inlet of the auxiliary passage is arranged between a top part of the inner wall portion and the inner portion of the ceiling.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1A:
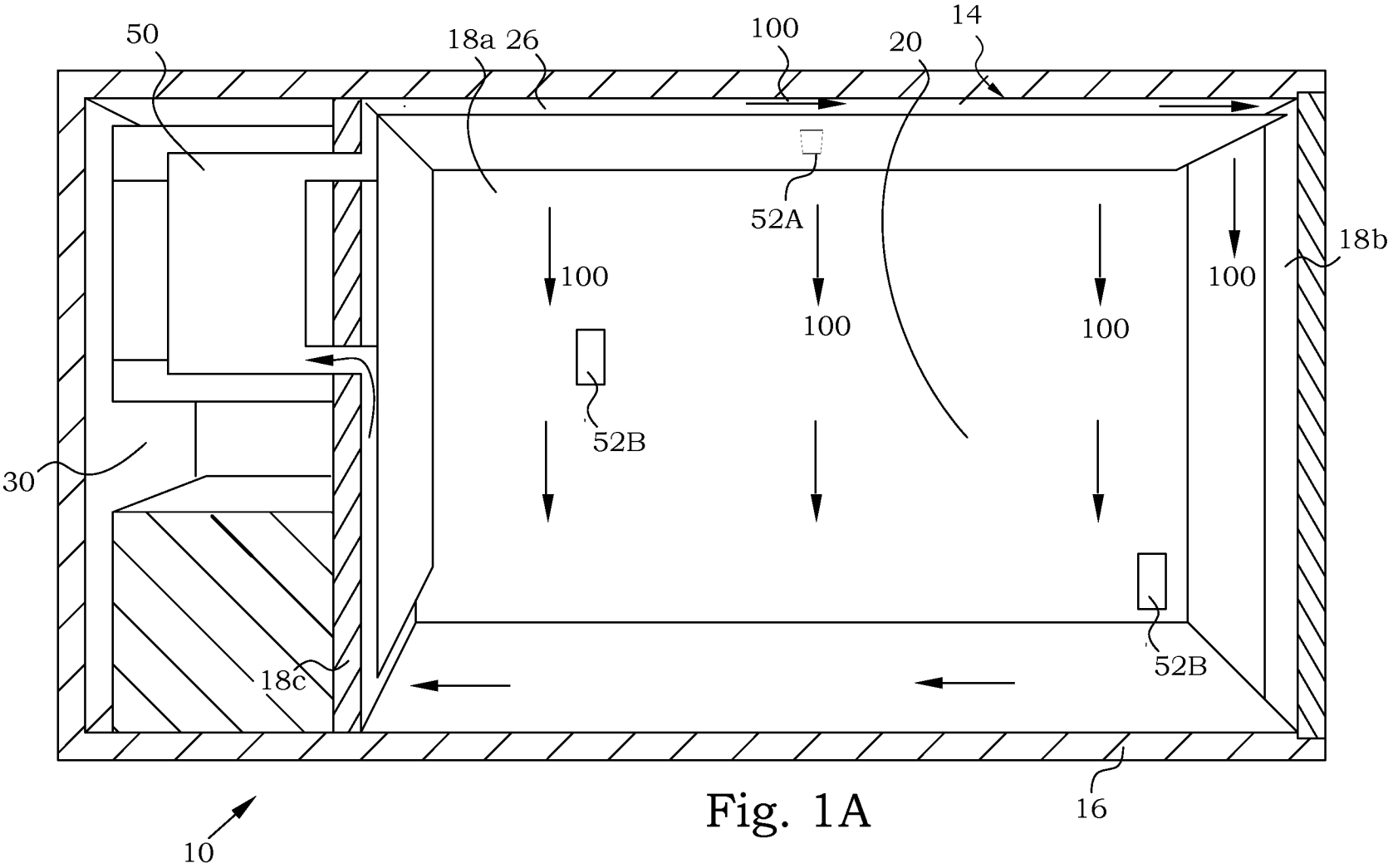
FIGS. 1A and 1B schematically show a freight container according to an exemplifying embodiment of the present invention.

FIG. 1A schematically shows a freight container 10 according to an exemplifying embodiment of the present invention. It will be appreciated that the freight container 10 may be substantially any container for the purpose of goods transportation. Preferably, the freight container 10 is an airfreight container, arranged for transportation in aircraft. The freight container 10 comprises a cargo compartment 20 being defined by a floor 16, a ceiling 14 and walls 18*a-c*. The freight container 10 further comprises a climate arrangement 50, configured for providing a climate-conditioned air-flow 100 into the cargo compartment 20 of the freight container 10. It will be appreciated that the freight container 10 may be constructed in many different ways, and that the distribution of the climate climate-conditioned air-flow 100 by the climate arrangement 50 in FIG. 1A is merely presented as an example. According to FIG. 1A, the climate control system 50 is situated in a control compartment 30 that is separated from the cargo compartment 20. Upon operation, the climate control system 50 provides an air-flow 100 going out from the climate control system 50, into the main cargo compartment 20, and back to the climate control system 50.

The climate arrangement 50 comprises one or more environmental sensors 52A,B for sensing the temperature and/or the humidity in the cargo compartment 20. In this example, there is provided an environmental sensor 52A in the ceiling 14 of the cargo compartment 20 and two environmental sensors 52B in the wall 18*a* of the cargo compartment 20. It will be appreciated that the number and/or position of the environmental sensors of the freight container 10 may be arbitrary. The environmental sensors 52A,B are arranged or accommodated in respective recesses (not shown) of the ceiling 14 and the wall 18*a*.

Figure 1B:
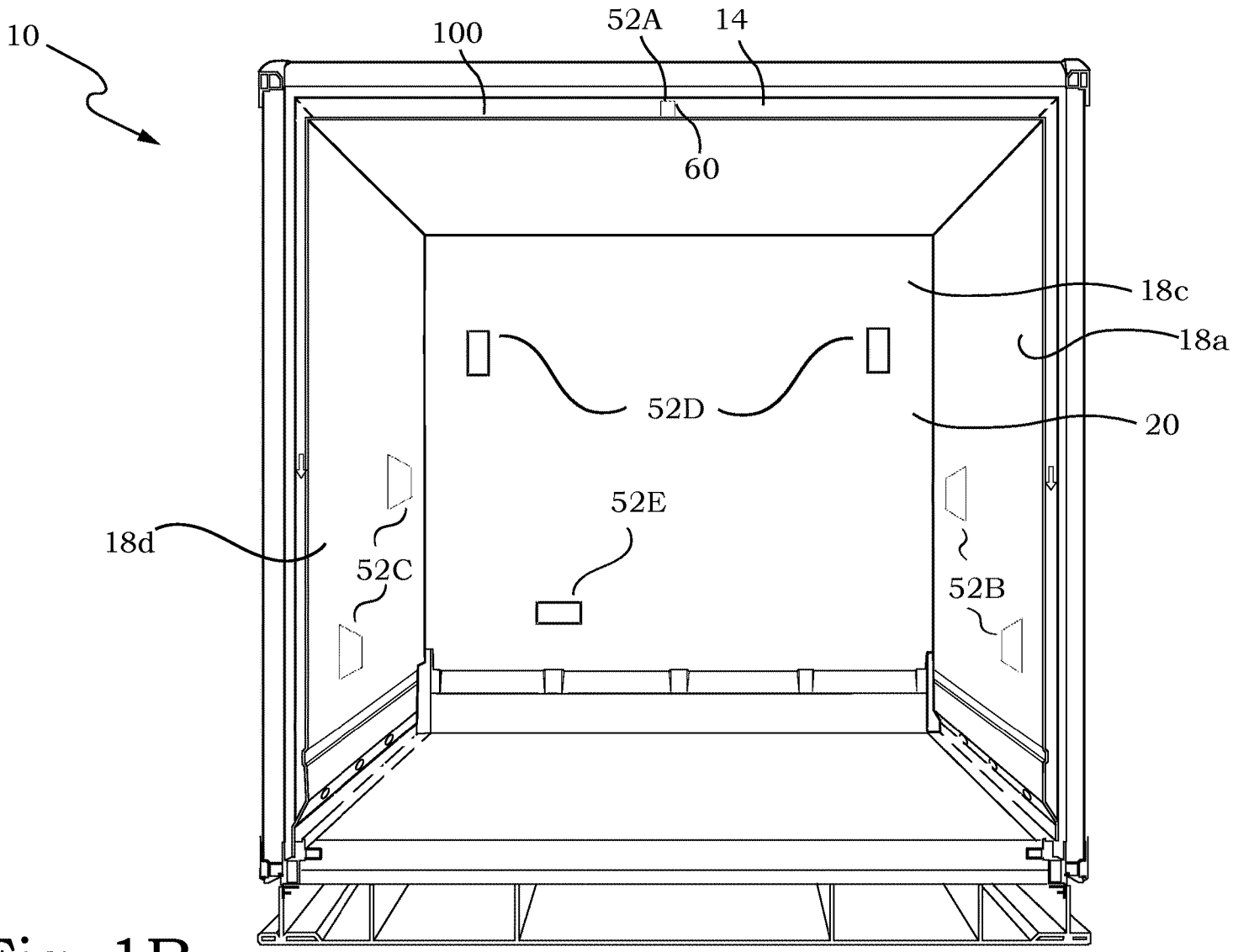

FIG. 1B schematically shows a freight container 10 according to an exemplifying embodiment of the present invention. It will be appreciated that FIG. 1B shows the freight container 10 as exemplified in FIG. 1A in an alternative view "through" a wall/door and towards the back wall 18*c*. Furthermore, as some references and/or functions of the freight container are omitted in FIG. 1B compared to FIG. 1A, it is referred to FIG. 1A for an increased understanding.

FIG. 1B shows that the environmental sensor 52A, which is provided in the ceiling 14 of the freight container 10, is arranged in a recess 60 of the ceiling 14. Analogously, the two environmental sensors 52B, which are provided in the wall 18*a* of the cargo compartment 20, and the two environmental sensors 52C, which are provided in the wall 18*d* of the cargo compartment 20, are provided in respective recesses (not shown). In the back wall 18*c*, the freight container 10 comprises two environmental sensors 52D in the upper left hand corner and the upper right hand corner, respectively, of the back wall 18*c*, and an environmental sensor 52E in a bottom portion of the back wall 18*c*.

Figure 2B:
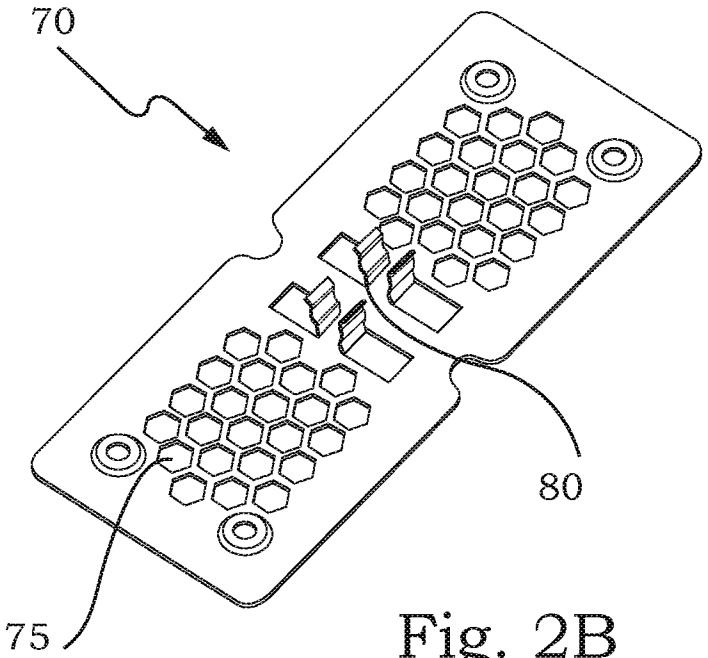
FIGS. 2A and 2B schematically show a recess arranged to accommodate an environmental sensor, and a cover for the recess, respectively, according to exemplifying embodiments of the present invention.
Figure 2A:
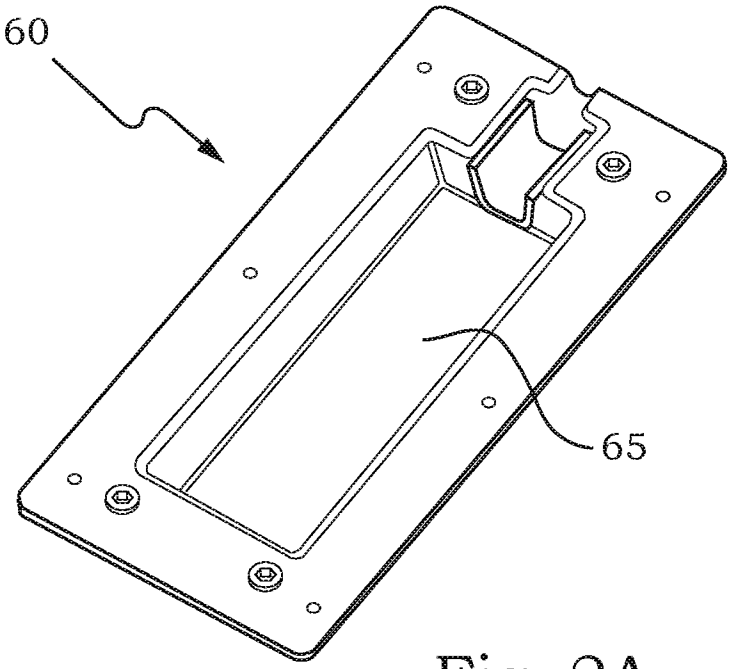

FIG. 2A schematically shows a recess 60 arranged to accommodate an environmental sensor according to an exemplifying embodiment of the present invention. In FIG. 2A, the recess 60 is exemplified as having a cuboid (parallelepiped) shape, but it should be noted that the recess 60 may have substantially any shape in which the environmental sensor may be accommodated. In the present example, the recess 60 comprises an insulating portion 65 in a bottom part of the recess 60.

Figure 3A:
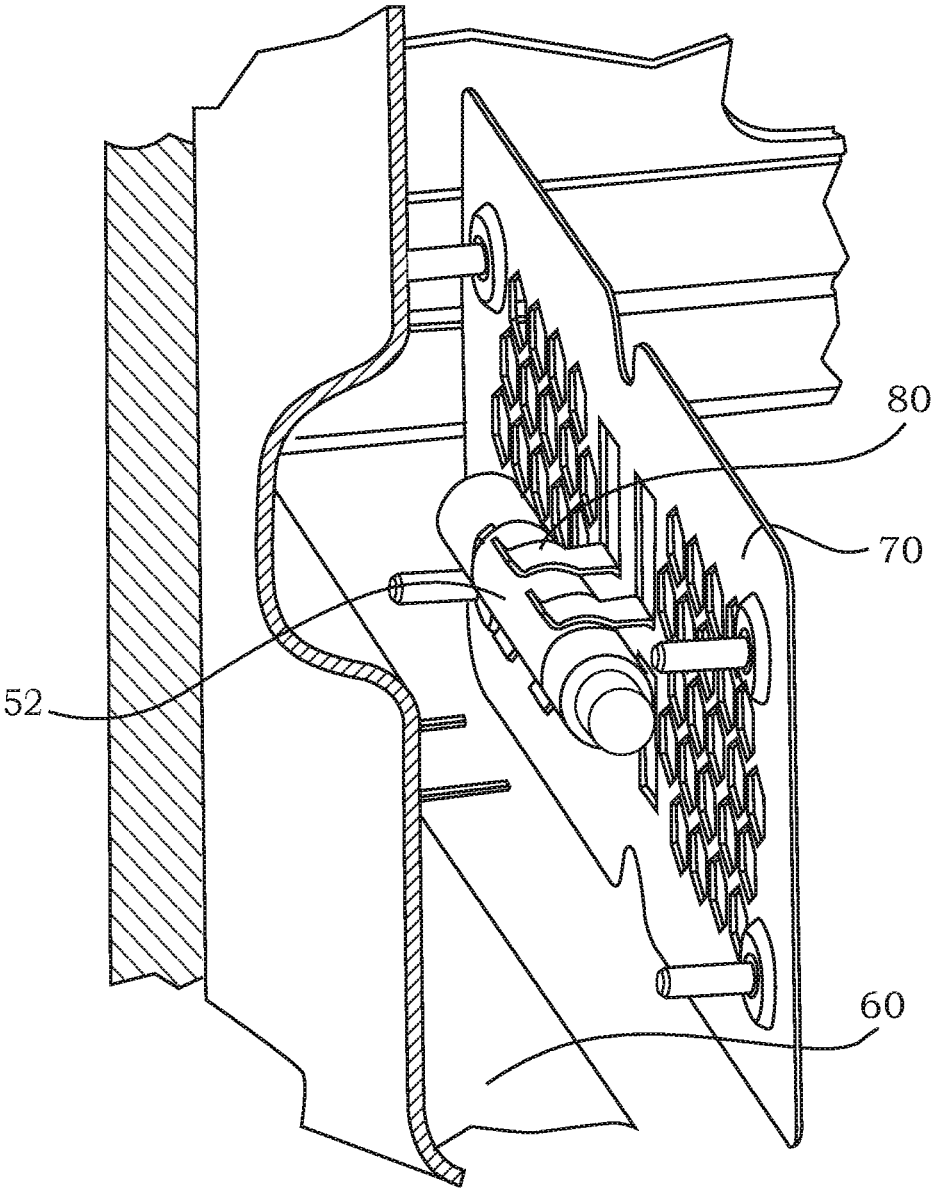
FIGS. 3A and 3B schematically show a recess, a cover and an environmental sensor according to an exemplifying embodiment of the present invention.

FIG. 2B schematically shows a cover 70 for the recess 60 according to an exemplifying embodiment of the present invention. The cover 70 may comprise a metal plate having a plurality of apertures 75. The cover 70 is configured to hold an environmental sensor (not shown), e.g. by a clamping arrangement 80 as exemplified. The cover 70 is further arranged to cover the environmental sensor in the recess 60. The cover 70 in FIG. 2B may be turned 180° and put over the recess 60 in FIG. 2A and fastened to the same. FIG. 3A schematically shows a recess 60, a cover 70 and an environmental sensor 52 according to an exemplifying embodiment of the present invention. It should be noted that the cover 70, which holds the environmental sensor 52, is shown in a position in which it is about to be fastened to a ceiling or wall of the freight container where the recess 60 is provided. The environmental sensor 52 is held by the cover 70 by a clamping arrangement 80.

Figure 3B:
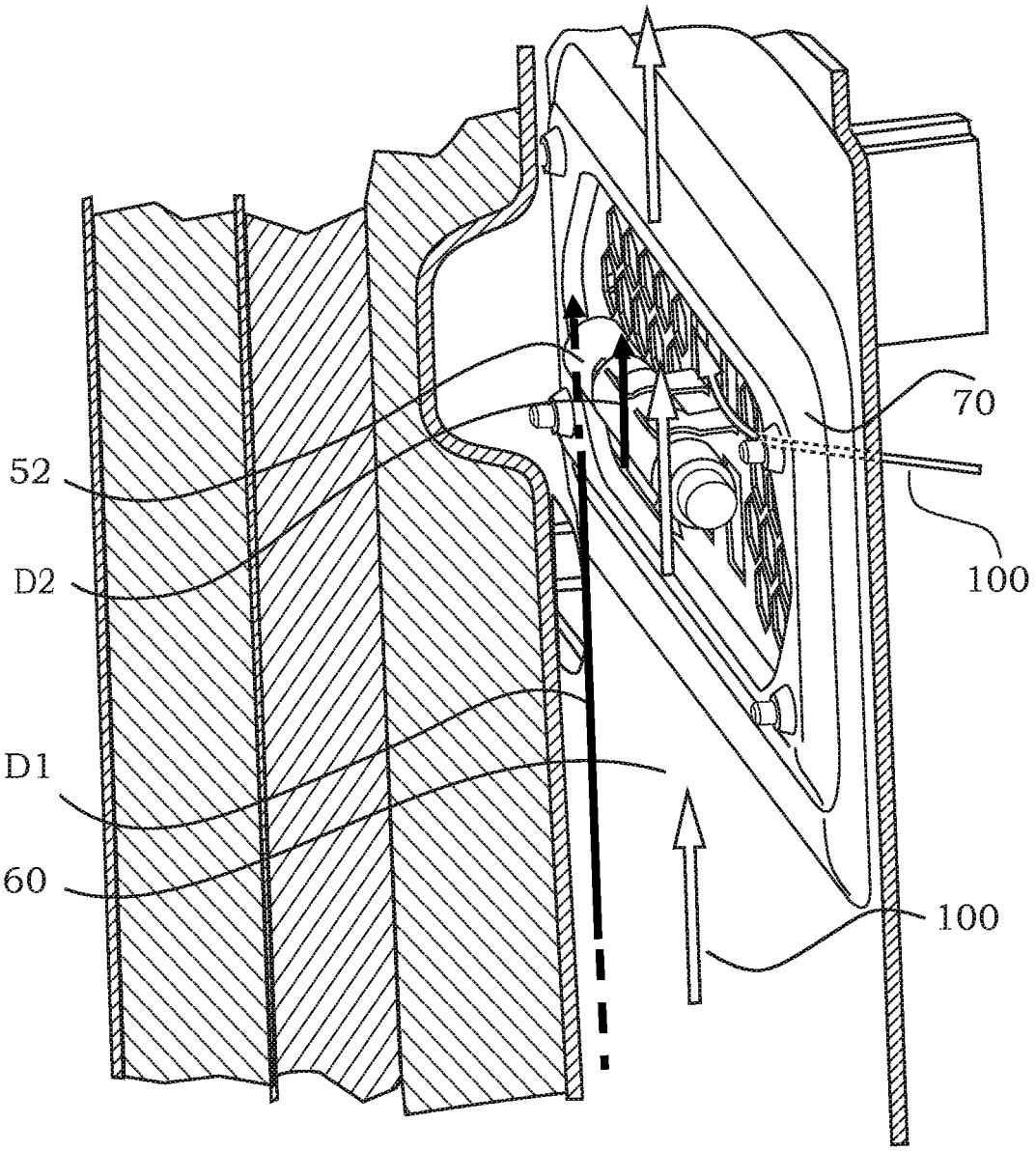

FIG. 3B, which corresponds to FIG. 3A, schematically shows a recess 60, a cover 70 and an environmental sensor 52 according to an exemplifying embodiment of the present invention. It should be noted that the cover 70, which holds the environmental sensor 52, has been fastened to a ceiling or wall where the recess 60 is provided. The cover 70 is arranged flush with the ceiling or wall in which the environmental sensor 52 is accommodated. In this particular embodiment of the freight container, the recess 60 has a first dimension, D1, which is larger than a second dimension, D2, of the environmental sensor 52 and/or the cover 70 in a plane of the ceiling or wall in which the environmental sensor 52 is accommodated. By this configuration of the recess 60 with respect to the environmental sensor 52, and in this case also with respect to the cover 70, the recess 60 provides a passage of a flow 100 of the climate-conditioned air-flow through the recess 60. More specifically, and as indicated in FIG. 3B, a portion of the flow 100 may pass in the recess 60 behind the environmental sensor 52 with respect to the cargo compartment of the freight container. Furthermore, a portion of the flow 100 may pass through the apertures of the cover 70 and into the recess 60.

Figure 4:
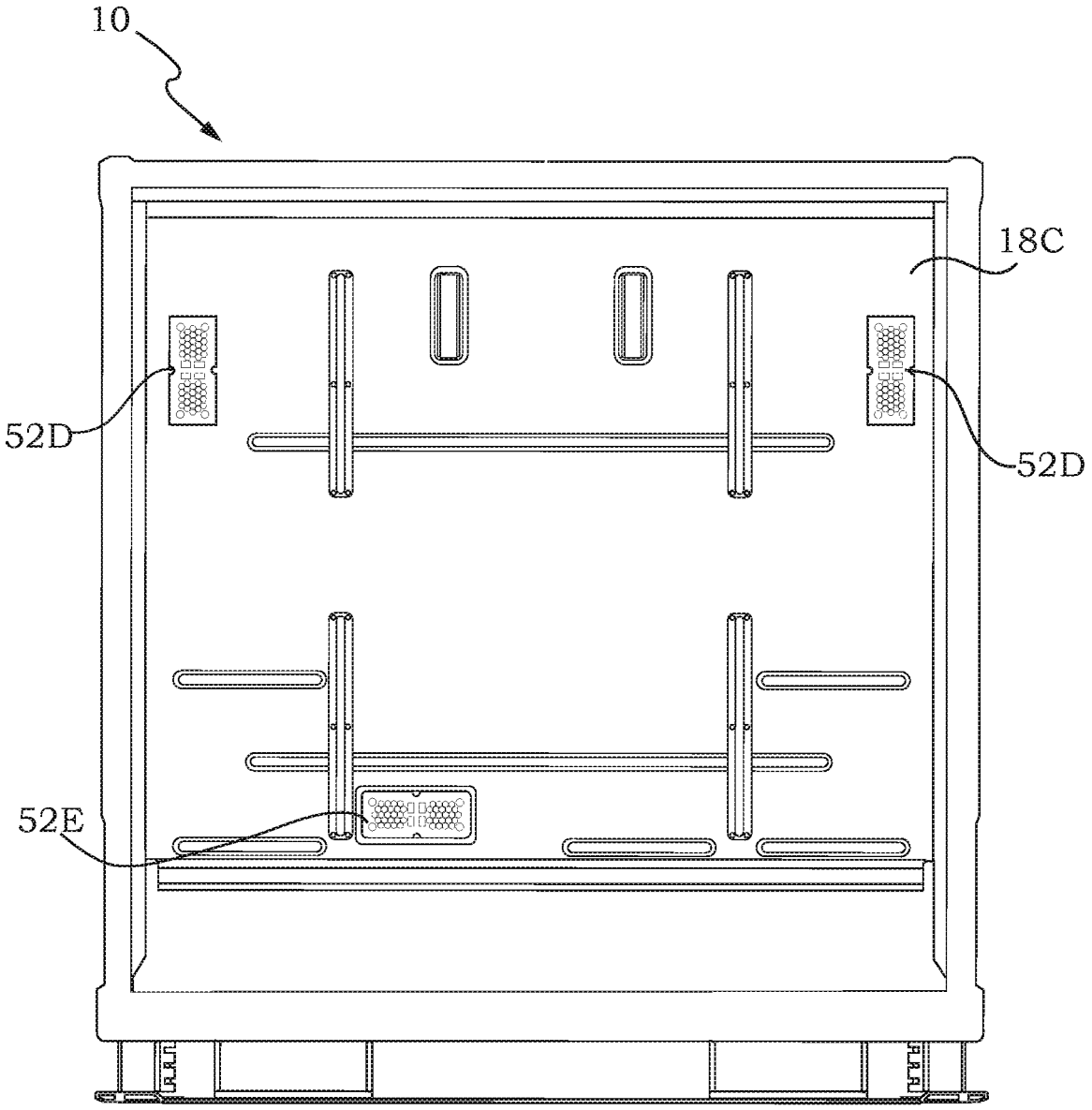
FIG. 4 schematically shows a wall of the freight container according to an exemplifying embodiment of the present invention.

FIG. 4 shows a wall 18*c* of the freight container 10 according to an exemplifying embodiment of the present invention. The wall 18*c* in FIG. 4 corresponds to the back wall 18*c* shown in FIG. 1B. Two environmental sensors 52D are arranged in the upper left hand corner and the upper right hand corner, respectively, of the back wall 18*c*, and an environmental sensor 52E is arranged in a bottom portion of the back wall 18*c*.

According to some of the previously described embodiments, the recesses respectively comprises a cover configured to hold the environmental sensor. The cover is arranged flush with the wall 18*c* and comprises a metal plate having a plurality of apertures. The recess which accommodates the environmental sensor 53E has a first dimension, D1, which is larger than a second dimension, D2, of the environmental sensor 53E in a plane of the wall 18*c*, as illustrated in FIG. 3B. By this configuration, the respective recess provides a passage of a flow of the climate-conditioned air-flow environmental through the recess. The two recesses accommodating the two environmental sensors 52D in FIG. 4 are further described in FIG. 5 and the associated text.

Figure 5:
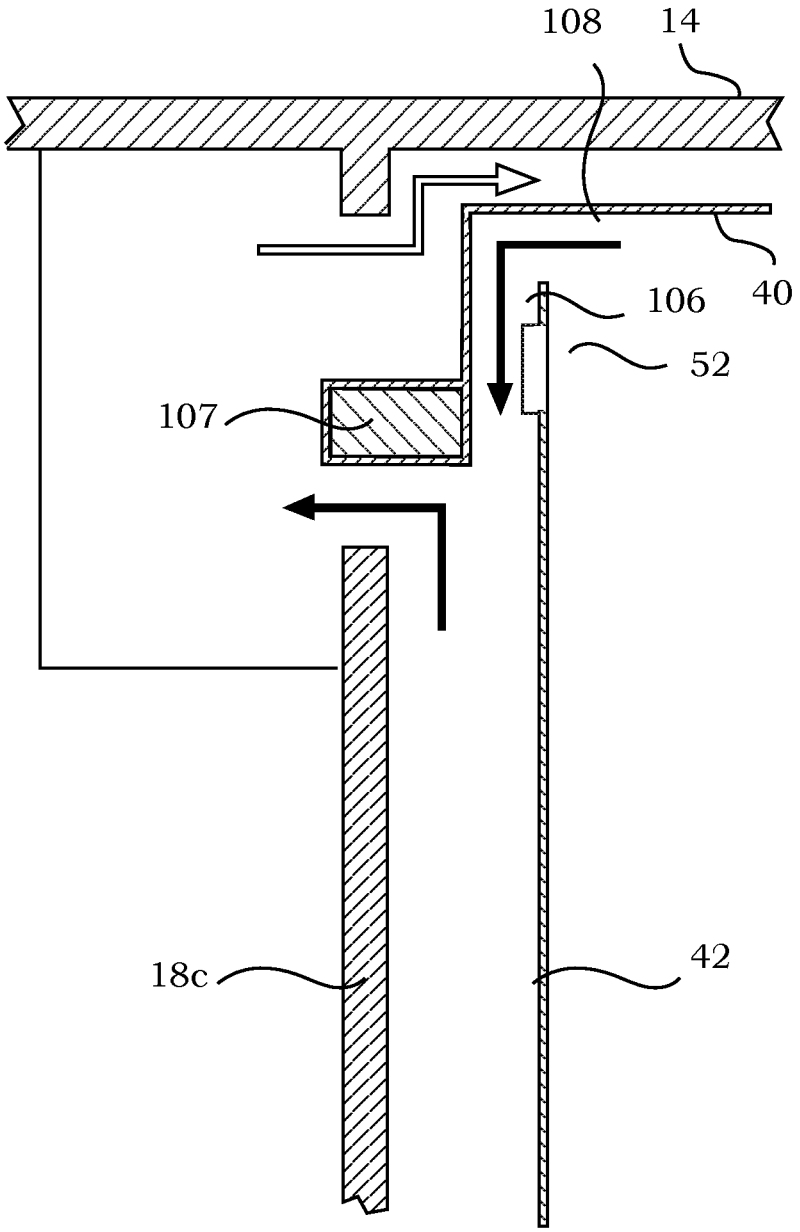
FIG. 5 schematically shows a part of a freight container according to an exemplifying embodiment of the present invention.

FIG. 5 schematically shows a portion of a freight container according to an exemplifying embodiment of the present invention. For reasons of simplicity, FIG. 5 indicates the upper leftmost portion of the freight container as exemplified in FIG. 1A and the associated text. However, FIG. 5 shows an alternative configuration of this part of the freight container. More specifically, the freight container comprises an inner wall portion 42 of the back wall 18*c*, and an inner portion 40 of the ceiling 14. An auxiliary passage 106 is provided in vicinity of the inner portion 40 of the ceiling 14. The inlet 108 of the auxiliary passage 106 is a slit which is provided between a top part of the inner wall portion 42 and the inner portion 40 of the ceiling 14, wherein the slit elongates along the length of the inner wall portion 42. The auxiliary passage 106 is provided between the inner wall portion 42 and an isolating element 107. The inner wall portion 42 comprises a recess in which an environmental sensor 52 is accommodated. The recess constitutes a through hole in the inner wall portion 42. Hence, the environmental sensor 52 is configured to sense the temperature on either side of the inner wall portion 42, i.e. in the cargo compartment and the auxiliary passage 106.

It should be noted that the environmental sensor 53E, as described in FIG. 3B and the associated text, may also be arranged in the inner wall portion 42.

The person skilled in the art realizes that the present invention by no means is limited to the preferred embodiments described above. On the contrary, many modifications and variations are possible within the scope of the appended claims. For example, one or more of the cargo compartment 20, the climate arrangement 50 and/or the recesses 60, etc., may have different shapes, dimensions and/or sizes than those depicted/described.

The invention claimed is:

1. A freight container, comprising:

a cargo compartment being defined by a floor, a ceiling and walls;

a climate arrangement, said climate arrangement being a device configured to provide a climate-conditioned air-flow, wherein said climate arrangement is configured for providing said climate-conditioned air-flow into said cargo compartment of said freight container, wherein said climate arrangement comprises at least one environmental sensor for sensing at least one of a temperature and a humidity in said cargo compartment; and at least one of said ceiling and walls comprises at least one recess in which said at least one environmental sensor is accommodated, wherein said at least one recess is at least one of a cavity within said at least one of said ceiling and walls, an opening within said at least one of said ceiling and walls, or a through hole through said at least one of said ceiling and walls, wherein said at least one recess comprises a cover attached to said at least one environmental sensor in said at least one recess, and wherein a first dimension, D1, of said at least one recess is larger than a second dimension, D2, of said at least one environmental sensor in a plane of the at least one of said ceiling and walls in which said at least one environmental sensor is accommodated, wherein said at least one recess provides a passage of a flow of the climate-conditioned air-flow through said at least one recess, wherein said ceiling comprises an inner portion and an outer portion defining a first space; and at least one of said walls comprises an inner wall portion and an outer wall portion defining a second space; wherein said first space is fluidically connected to said second space, and said inner wall portion comprises at least one aperture between said second space and said cargo compartment; wherein said climate arrangement is configured to provide said climate-conditioned air-flow into said cargo compartment of said freight container via said first space and said second space; and wherein at least one of said inner portion and said inner wall portion comprises said at least one recess in which said at least one environmental sensor is accommodated.

2. The freight container according to claim 1, wherein said cover is arranged flush with at least one of said ceiling and walls in which said at least one environmental sensor is accommodated.

3. The freight container according to claim 1, wherein said cover comprises a metal plate having a plurality of apertures.

4. The freight container according to claim 1, wherein said at least one environmental sensor resiliently projects from at least one of said ceiling and walls in which said at least one environmental sensor is accommodated.

5. The freight container according to claim 1, wherein said at least one recess comprises an insulating portion in a bottom part of said at least one recess.

6. The freight container according to claim 1, wherein the at least one environmental sensor comprises a temperature sensor.

7. The freight container according to claim 1, wherein the at least one environmental sensor comprises a humidity sensor.

8. The freight container according to claim 1, wherein only said walls, of said at least one of said ceiling and walls, comprises said at least one recess in which said at least one environmental sensor is accommodated, wherein said inner wall portion of said at least one wall comprises said at least one recess.

9. The freight container according to claim 1, wherein said at least one recess constitutes a through hole in said at least one of said inner portion and said inner wall portion.

10. The freight container according to claim 1, wherein at least one of said walls comprises an inner wall portion and an outer wall portion defining a third space, wherein said cargo compartment of said freight container is fluidically connected to said third space and wherein said climate arrangement is configured to return a residual air-flow of said climate-conditioned air-flow from said cargo compartment of said freight container via said third space.

11. The freight container according to claim 10, wherein said third space comprises an auxiliary passage arranged in vicinity of said inner portion of said ceiling, wherein an inlet of said auxiliary passage is arranged between a top part of said inner wall portion and said inner portion of said ceiling.

12. A method for sensing at least one of a temperature and a humidity in a freight container, comprising:

a cargo compartment being defined by a floor, a ceiling and walls;

a climate arrangement, said climate arrangement being a device configured to provide a climate-conditioned air-flow, wherein said climate arrangement is configured for providing a climate-conditioned air-flow into said cargo compartment of said freight container; wherein said climate arrangement comprises at least one environmental sensor for sensing at least one of a temperature and a humidity in said cargo compartment;

wherein said ceiling comprises an inner portion and an outer portion defining a first space; and at least one of said walls comprises an inner wall portion and an outer wall portion defining a second space; wherein said first space is fluidically connected to said second space, and said inner wall portion comprises at least one aperture between said second space and said cargo compartment; wherein said climate arrangement is configured to provide said climate-conditioned air-flow into said cargo compartment of said freight container via said first space and said second space;

said method comprising the steps of:

providing at least one recess in at least one of said ceiling and walls, wherein at least one of said inner portion and said inner wall portion comprises said at least one recess in which said at least one environmental sensor is accommodated, wherein said at least one recess is at least one of a cavity within said at least one of said ceiling and walls, an opening within said at least one of said ceiling and walls, or a through hole through said at least one of said ceiling and walls, wherein said at least one recess comprises a cover attached to said at least one environmental sensor, and wherein a first dimension, D1, of said at least one recess is larger than a second dimension, D2, of said at least one environmental sensor in a plane of the at least one of said ceiling and walls in which said at least one environmental sensor is accommodated, wherein said at least one recess provides a passage of a flow of the climate-conditioned air-flow through said at least one recess, and accommodating, in said at least one recess, said at least one environmental sensor for sensing at least one of a temperature and a humidity in said cargo compartment.

* * * * *